United States Patent [19]

Grellmann et al.

[11] Patent Number: 4,695,811

[45] Date of Patent: Sep. 22, 1987

[54] HIGH FREQUENCY COAXIAL SWITCH

[75] Inventors: Heinz E. Grellmann, Beaverton; Leonard A. Roland, Portland, both of Oreg.

[73] Assignee: Tektronix, Inc., Beaverton, Oreg.

[21] Appl. No.: 890,044

[22] Filed: Jul. 28, 1986

[51] Int. Cl.[4] ..... H01P 1/10

[52] U.S. Cl. ..... 333/105; 333/107; 333/33; 333/81 A; 333/262; 333/238

[58] Field of Search ..... 333/33, 81 A, 105, 107, 333/262, 161; 200/153 S; 335/4, 5

[56] References Cited

U.S. PATENT DOCUMENTS

| | | | |
|---|---|---|---|
| 2,854,543 | 9/1958 | Wilson | 333/105 X |
| 3,114,887 | 12/1963 | Wedemeyer | 333/105 |
| 3,319,194 | 5/1967 | Adam | 333/81 A |
| 4,070,637 | 1/1978 | Assal et al. | 333/105 |
| 4,317,972 | 3/1982 | Kjellberg | 200/153 S |
| 4,496,806 | 1/1985 | Maenishi et al. | 333/262 X |
| 4,595,893 | 6/1986 | Charbonnier et al. | 333/262 X |

OTHER PUBLICATIONS

Morton, *Matched Impedance Coaxial Cable Connector*, IBM Technical Disclosure Bulletin, vol. 17, No. 5, Oct. 1974, p. 1335.

*Primary Examiner*—Paul Gensler
*Attorney, Agent, or Firm*—Francis I. Gray

[57] ABSTRACT

A high frequency coaxial switch has a coaxial connector mounted on a housing to provide electrical access to a cavity within the housing, the cavity being small to suppress moding. The coaxial connector is electrically connected to a microstrip conductor on a hybrid circuit board within the cavity, and switching is accomplished by compensated contact striplines which electrically make or break contact with the microstrip conductor.

6 Claims, 5 Drawing Figures

HIGH FREQUENCY COAXIAL SWITCH

BACKGROUND OF THE INVENTION

The present invention relates to DC to high frequency switching using coaxial lines and connectors, and more particularly to a high frequency coaxial switch which has compensated transitions from coaxial to microstrip to stripline and back.

Current high frequency switches, such as the Model S-2813 made by RLC Electronics of New Jersey, use stripline contacts to the coaxial center conductors directly. These devices are effective up to 18–26 GHz, but attempts to extend this technology up to 40+ GHz have not been successful due to the small size of the components at that frequency range. There are some coaxial connectors designed to operate in the 40+ GHz range, such as the K connector manufactured by Wiltron of Mountain View, Calif. The center conductor of such connectors is approximately 0.012" in diameter which results in a very small surface contact area for a stripline switch.

Another type of high frequency switch is described in co-pending U.S. patent application Ser. No. 728,130 filed Apr. 29, 1985 by the present inventors entitled "Integrated Pad Switch". This switch has the contacts embedded in a dielectric substrate and requires a smooth hybrid substrate, such as polished quartz which is not suitable for high power attenuator applications due to the low thermal coefficient of conduction. The dielectric substrate introduces some insertion loss at high frequencies.

Therefore, what is desired is a high frequency coaxial switch which is reliable, has low insertion loss and has improved power handling capabilities.

SUMMARY OF THE INVENTION

Accordingly, the present invention provides a high frequency coaxial switch which has compensated transitions from coaxial to microstrip to stripline, with the switching being done by stripline. A high frequency coaxial connector has its center conductor connected to a microstrip conductor on a hybrid circuit board within a small cavity to suppress moding. A movable contact stripline makes or breaks contact with the microstrip conductor to perform the switching function.

The objects, advantages and other novel features of the present invention will be apparent from the following detailed description when read in conjunction with the appended claims and attached drawing.

DESCRIPTION OF THE PREFERRED EMBODIMENT

Figure 1:
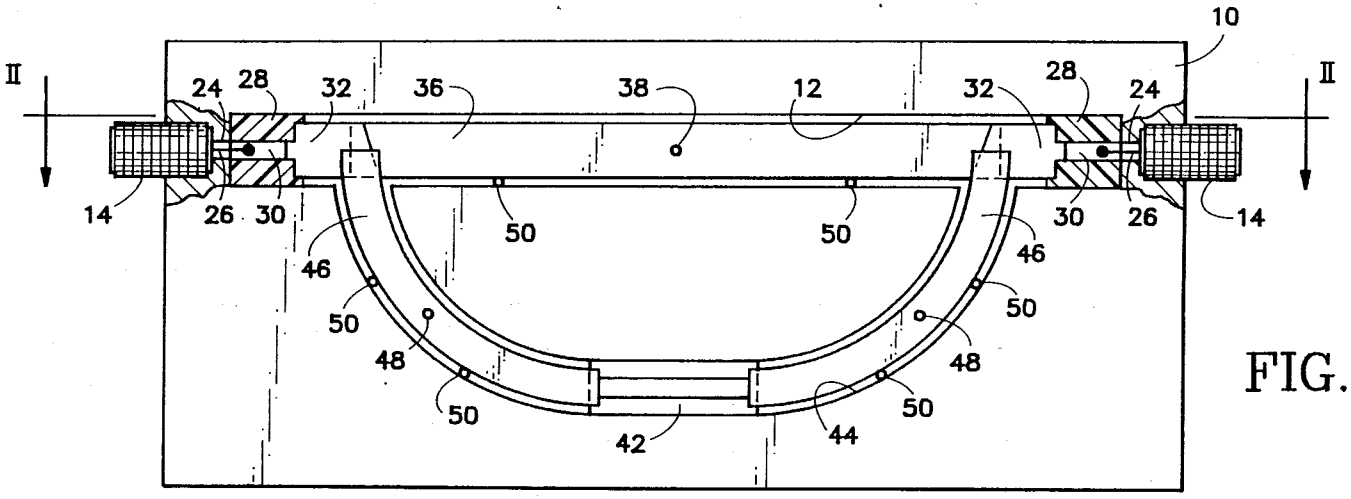
FIG. 1 is a top plan view of a high frequency coaxial switch according to the present invention with the cavity cover removed.
Figure 2:
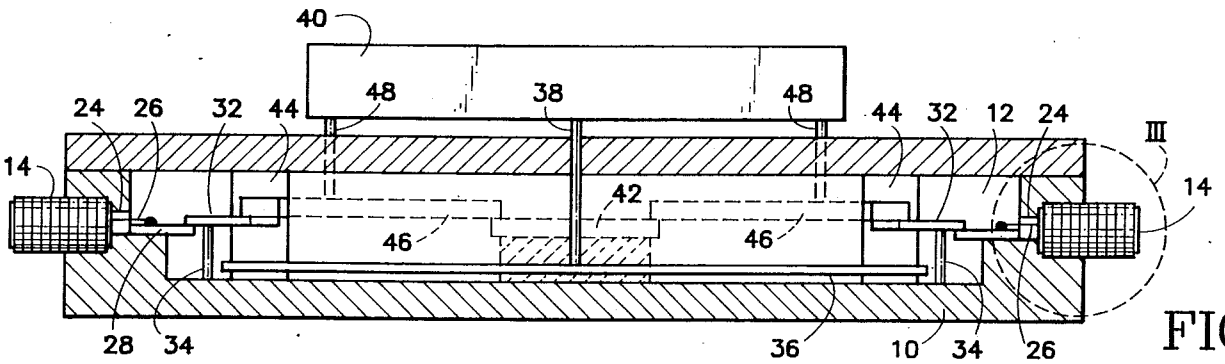
FIG. 2 is a cross-sectional side view of the high frequency coaxial switch of FIG. 1 taken along the line II—II.
Figure 3:
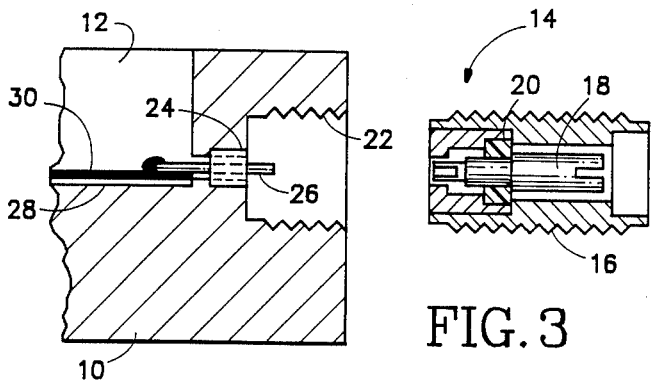
FIG. 3 is a partially exploded cross-sectional view of the high frequency coaxial connector interface with a microstrip conductor on a hybrid circuit board.

Referring now to FIGS. 1–3 a housing 10 has a cavity 12 therein. One or more high frequency coaxial connectors 14 provide electrical access to the cavity 12. The connector 14, such as the Wiltron K connector, has a sparkplug assembly 16 with a center conductor 18 supported by an insulator bead 20. The sparkplug assembly 16 has external threads which mate with internal threads of a connector cavity 22 in the housing 10. A launcher bead 24 supports a transition center conductor 26 and is mounted in the housing 10 to connect the connector cavity 22 with the housing cavity 12. When the sparkplug assembly 16 is screwed into the connector cavity 22, the transition center conductor 26 mates with the connector center conductor 18. A hybrid circuit board 28 is mounted in the cavity 12 and has a microstrip conductor 30 thereon. The portion of the transition center conductor 26 which extends into the cavity 12 is electrically connected to the microstrip conductor 30 by any suitable means, such as by soldering. This is a conventional high frequency coaxial cable connection to a hybrid electronic circuit within a housing.

Electrically connected to the microstrip conductor is a portion of compensated stripline 32 supported by an appropriate insulated standoff 34. Within the cavity 12 is a contact stripline 36 which extends from one end of the cavity to the other and which partially overlaps the stripline portions 32 connected to respective high frequency coaxial connectors 14 via the microstrip conductors 30. The contact stripline 36 is connected by suitable means, such as a rod 38, to an actuator 40 which may be a conventional push-pull solenoid. The actuator 40 causes the contact stripline 36 to make or break contact with the stripline portions 32 to provide an open or closed circuit through the cavity 12. FIGS. 1 and 2 illustrate an embodiment whereby an electronic circuit 42, such as an attenuator pad, can be switched into a high frequency circuit between the connectors 14 at the ends of the cavity 12. The circuit 42 is situated in an auxiliary cavity 44 which is contiguous with the main cavity 12. A hybrid circuit having a substrate of a higher coefficient of thermal conduction, such as alumina or beryllium oxide, may be used as opposed to polished quartz or the like for improved attenuation pads in high power applications. Extending from each end of the circuit 42 are bypass contact striplines 46 which are configured to fit within the auxiliary cavity 44 and to electrically connect the circuit between the respective stripline portions 32. The bypass contact striplines 46 are connected by suitable means, such as rods 48, to the actuator 40 so that switching occurs in conjunction with the switching of the contact stripline. Insulated guide pins 50 assure that the contact striplines 36 and 46 remain in proper alignment and do not contact the housing.

Figure 4:
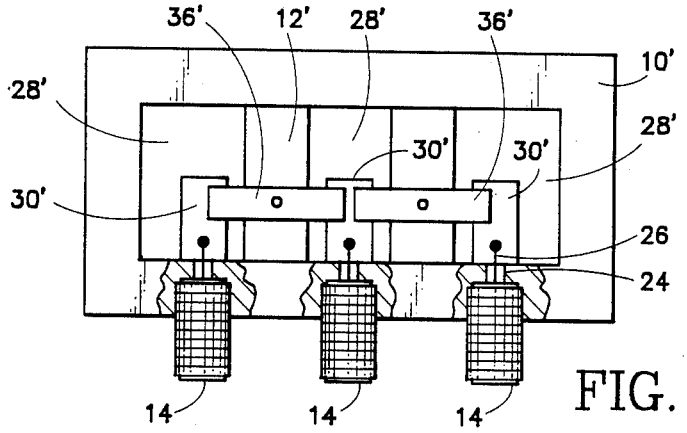
FIG. 4 is a top plan view of a single pole, double throw high frequency coaxial switch according to the present invention.

FIG. 4 illustrates an embodiment for a single pole, double throw switch using three high frequency coaxial connectors 14 which are aligned in a row along the side of the cavity 12'. Each transition center conductor 26 is connected to the microstrip conductor 30' of respective hybrid circuit boards 28'. A pair of contact striplines 36' are configured to overlap two of the microstrip conductors 30' such that either or both end connectors 14 may be connected to the center connector.

Figure 5:
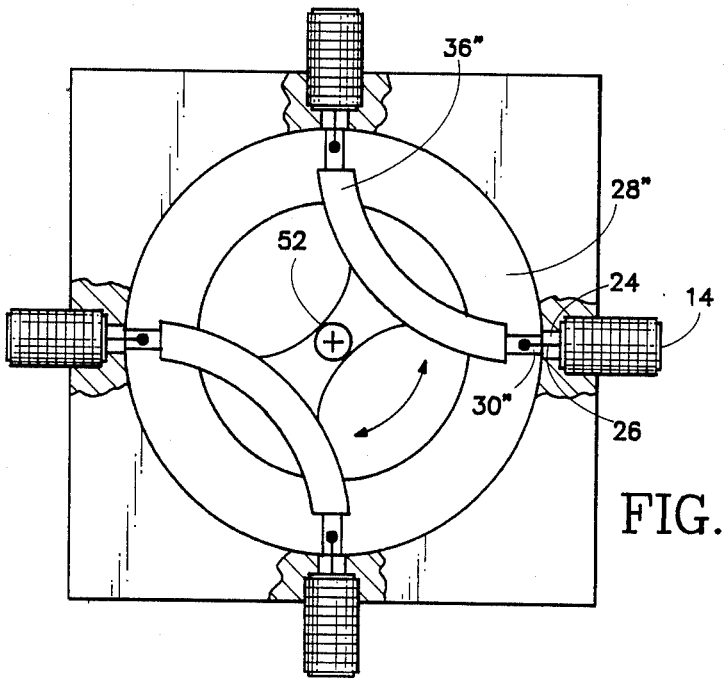
FIG. 5 is a top plan view of a four-port rotary high frequency coaxial switch according to the present invention.

Also shown in FIG. 5 is a four-port switch where the contact striplines 36" are configured to connect adjacent connectors 14. The contact striplines 36″ are connected to each other by a central insulated mount 52 which is connected by suitable means to a rotary actuator. The central portion of the hybrid circuit board 28″ is removed.

Thus, the present invention provides a high frequency coaxial switch which has compensated transitions from coaxial to microstrip to stripline to provide the switching function with a concomitant reduced insertion loss and better power handling characteristics due to the larger contact area.

What is claimed is:

1. A high frequency coaxial switch comprising:

a housing having a cavity;

a hybrid circuit board mounted within the cavity, the hybrid circuit board having a microstrip conductor thereon;

a first coaxial connector mounted on the housing and electrically connected to the microstrip conductor to provide electrical access to the cavity;

a first contact stripline situated within the cavity so as to overlap the microstrip conductor; and means for moving the first contact stripline to make or break electrical contact with the microstrip conductor.

2. A high frequency coaxial switch as recited in claim 1 further comprising a stripline portion mounted within the cavity, the stripline portion being electrically connected to the microstrip conductor, and being configured to provide an impedance match with the microstrip conductor, the first contact stripline making or breaking electrical contact with the stripline portion with the moving means is actuated.

3. A high frequency coaxial switch as recited in claim 1 further comprising:

a plurality of coaxial connectors mounted on the housing, each coaxial connector being electrically connected to a separate microstrip conductor on a common hybrid circuit board; and a second contact stripline connected to the moving means, the first and second contact striplines being configured to electrically connect adjacent exclusive pairs of the coaxial connectors and, when the moving means is actuated, to electrically connect different exclusive pairs of the coaxial connectors.

4. A high frequency coaxial switch as recited in claim 1 further comprising a second coaxial connector mounted on the housing and electrically connected to a microstrip conductor on a second hybrid circuit board within the cavity such that, when the moving means is actuated, the first contact stripline either opens or closes a through electrical path between the first and second coaxial connectors.

5. A high frequency coaxial switch as recited in claim 4 further comprising:

an interior electrical circuit mounted within the cavity; and a bypass contact stripline situated within the cavity and connected to the moving means such that, when the moving means is actuated, causing the first contact stripline to open the through electrical path, the bypass contact stripline electrically connects the interior electrical circuit between the first and second coaxial connectors.

6. A high frequency coaxial switch as recited in claim 4 further comprising:

a third coaxial connector mounted on the housing and electrically connected to a microstrip conductor on a third hybrid circuit board within the cavity; and a second contact stripline connected to a second moving means such that, when the second moving means is actuated, the second contact stripline either opens or closes a through electrical path between the first and third coaxial connectors.

* * * * *